US008210579B2

(12) United States Patent
Vilkomirski

(10) Patent No.: US 8,210,579 B2
(45) Date of Patent: Jul. 3, 2012

(54) AUTOMATIC LATCH AND TOOLBOX

(75) Inventor: Gil Vilkomirski, Petach Tigwa (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 1149 days.

(21) Appl. No.: 11/681,482

(22) Filed: Mar. 2, 2007

(65) Prior Publication Data

US 2007/0222231 A1 Sep. 27, 2007

Related U.S. Application Data

(60) Provisional application No. 60/778,385, filed on Mar. 3, 2006.

(51) Int. Cl.
*B30B 15/00* (2006.01)

(52) U.S. Cl. ..... 292/100; 292/DIG. 31; 292/DIG. 37

(58) Field of Classification Search ..... 292/100, 292/240, 243, 241, 95, 121, 122, 126, 128, 292/219, 220, 226, 228, 200, DIG. 31 X, 292/DIG. 37 X, DIG. 61
See application file for complete search history.

(56) References Cited

U.S. PATENT DOCUMENTS

| | | | | |
|---|---|---|---|---|
| 2,426,754 | A | 2/1944 | Thiele | 70/70 |
| 3,100,980 | A * | 8/1963 | Humphries | 70/71 |
| 3,797,870 | A * | 3/1974 | Beckman | 70/84 |
| 4,268,007 | A * | 5/1981 | Chittenden | 251/30.02 |
| 5,570,915 | A * | 11/1996 | Asadurian | 292/242 |
| 5,598,613 | A * | 2/1997 | Feile et al. | 24/641 |
| 7,644,963 | B2 * | 1/2010 | Fan et al. | 292/95 |
| 2002/0158474 | A1 * | 10/2002 | Cowper | 292/194 |
| 2004/0195843 | A1 * | 10/2004 | Rotondi et al. | 292/121 |
| 2006/0103140 | A1 * | 5/2006 | Bella et al. | 292/95 |

FOREIGN PATENT DOCUMENTS

| | | |
|---|---|---|
| DE | 2158972 | 6/1973 |
| EP | 0 482 249 A1 | 12/1990 |

OTHER PUBLICATIONS

International Search Report issued for PCT Patent Application No. PCT/US2007/063195, dated Aug. 2, 2007.

* cited by examiner

*Primary Examiner* — Carlos Lugo
*Assistant Examiner* — Mark Williams
(74) *Attorney, Agent, or Firm* — Pillsbury Winthrop Shaw Pittman LLP

(57) ABSTRACT

The invention provides an automatic latch having a first latch member and a second latch member. The first latch member may include an opening and a cam structure. The second latch member may include a pivoted structure that includes a protrusion and a cam surface. The second latch member may also include a spring having first and second spring portions. As the cam structure is advanced towards the cam surface of the pivoted structure such that the cam structure passes over the protrusion of the pivoted structure, the first spring portion applies a bias causing the protrusion to protrude through the opening of the first latch member when the cam structure clears the protrusion. Thus, the latch is placed in a locked configuration. When in the locked configuration, the second spring portion applies a bias that tends to separate the first latch member from the second latch member, so that the latch may spring apart when intentionally unlocked.

5 Claims, 11 Drawing Sheets

AUTOMATIC LATCH AND TOOLBOX

CROSS-REFERENCE TO RELATED APPLICATIONS

This application claims priority to U.S. Provisional Patent Application No. 60/778,385, filed Mar. 3, 2006, which is hereby incorporated by reference in its entirety.

BACKGROUND OF THE INVENTION

1. Field of the Invention

The invention relates to an automatic latch and a toolbox utilizing the same.

2. Description of Related Art

Typical latches require multiple steps to secure objects together. For example, to secure a toolbox lid with a latch, a user must first ensure that the latch does not obstruct closing of the lid, the user may then close the lid completely and engage the latch. In some instances, engaging the latch may include two or more steps.

In some environments, users may only have one available hand with which to secure a toolbox lid. Thus, a latch that the requires only a single motion to secure objects together may be advantageous. Furthermore, as mentioned above, typical latches usually must be first positioned properly before the objects can be moved into position to be latched. If the latch is not in proper position and the objects are moved, damage to the latch and/or the objects themselves can result. For example, in some toolbox configurations, if a portion of a toolbox lid latch is out of position when an attempt to close the toolbox lid is made, the toolbox lid and/or the latch may be damaged.

Other problems exist with typical latch design.

BRIEF SUMMARY OF THE INVENTION

The present disclosure relates to an automatic latch. The automatic latch of the invention enables a first object and a second object that are movable relative to one another to be secured together using a single motion. The single motion causes a catch portion of the latch to engage a tongue portion of the latch forming a catch/tongue complex. A first spring portion of the latch then provides tension to hold the catch/tongue complex in place so that the first and second objects are secured together and remain secured until the latch is intentionally released. In some embodiments, a second spring portion also provides tension tending to separate the catch/tongue complex when the latch is intentionally released.

An automatic latch according to one embodiment of the invention comprises an upper housing (or first body), a pivotable tongue, a lower housing (or second body), and/or other elements. The upper housing includes a catch or cam structure that may be flanked by two upper housing arms. The catch/cam structure forms the front edge of an upper housing opening, which is disposed through the upper housing body.

The tongue includes a leading edge at its first end. The leading edge has an angled surface (e.g., a cam surface) that forms a wedge. At the "top" of the wedge is a "top portion." The wedge formed by the angled surface of the leading edge terminates in a "drop-off surface." The top portion, the drop-off surface, and/or other elements of the tongue may form a protrusion of the tongue. In some embodiments, the tongue also includes a tail at its second end.

The automatic latch also includes the lower housing. In one embodiment, the tongue is fastened to the lower housing by placing the lower housing over the tongue and inserting the long fastener through holes in the lower housing and the tongue.

The automatic latch may also include the spring. The spring may be secured to the tongue by inserting the short fastener through holes in the spring and the tongue. In one embodiment, the spring may include two spring portions or "stress areas." Each spring portion or stress area involves a set of surfaces and/or other elements of the spring. When a force causes one or more of the surfaces or elements of the spring to move relative to one another, the rigidity of the spring creates counter-forces, tension (tension referring to potential energy generated by the counter-forces), and/or bias in the direction opposite to the relative movement. The areas of the spring that create tension, counter forces, or bias are referred to as stress areas. The tension, counter forces, or bias produces by the spring may be produced by compression, expansion, separation, or other stress on one or more parts of the spring.

In one embodiment, the catch/tongue complex may be formed/engaged by securing the upper housing to a complex comprising the assembled lower housing, tongue, and spring (e.g., a "lower complex" or second latch member). As the upper housing is advanced toward the lower complex, the catch/cam structure of the upper housing begins to engage the leading edge/cam surface of the tongue. When the catch engages the angled surface of the leading, it creates camming forces tending to pivot the leading edge in a first direction around the axis of the long fastener. These forces stress the first spring portion or first stress area of the spring, which creates counter-forces tending to pivot the leading edge of the tongue in a second direction opposite to the first direction around the axis of the long fastener, thus, creating tension tending in the second direction. As the upper housing is advanced further towards the lower complex, the catch further engages the leading edge of the tongue. As the catch engages the angled face of the leading edge, it forces the leading edge to further pivot in the first direction around the axis of the long fastener.

In some embodiments, an additional result of the upper housing being further advanced towards the lower complex is that the upper housing arms begin to engage toward surfaces of the spring. This begins to stress the second spring portion or second stress area of the spring, which creates tension and counter-forces opposing the advancement of the upper housing arms and thus, the upper housing itself. In some embodiments, other portions of the upper housing may engage the spring to stress the second spring portion or second stress area or otherwise create force tending to oppose the advancement of the upper housing relative to the lower complex.

As the upper housing is further advanced into the lower complex, the catch/cam structure travels up (in a relative fashion) the angled face/cam surface of the leading edge and over the top portion of the leading edge (over the protrusion of the tongue). Once the catch clears the top portion of the leading edge, the force/bias caused by the first spring portion or first stress area of the spring are at least partially released and cause the top portion of the leading edge to protrude through the upper housing opening. In this position, the drop-off surface of the leading edge engages the inside edge of the catch (the edge inside of the upper housing opening). This position comprises the locked configuration of the latch and secures the upper housing to the lower complex (e.g., with an engaged catch/tongue complex). If forces are applied attempting to move the upper housing and the lower complex away from one another, the catch/tongue complex prevents such movement (unless unlatching steps are taken, such as those described below).

Thus, the automatic latch may be used to secure together two objects that are movable relative to one another by attaching, for example, the upper housing to a first of the two objects and the lower complex to a second of the two objects and engaging the upper housing into the lower complex.

As mentioned above, the automatic latch may be released (i.e., the catch/tongue complex may be disengaged and the upper housing may be disengaged from the lower complex). In one embodiment, this may occur when a force is applied to the tail at the second end of the tongue. The tail may be pivoted to remove the top portion of the leading edge from the upper housing opening (disengaging/clearing the drop-off surface from the inner edge of the catch) allowing the upper housing to be withdrawn or otherwise moved away from the lower complex.

As mentioned above, in some embodiments, engaging the upper housing with the lower complex causes the upper housing arms to contact the spring and stress the second spring portion or second stress area of the spring. This causes tension from force/bias that tends to move the upper housing arms (and thus, the upper housing) away from the lower complex. When the tail of the tongue is actuated to disengage the catch/tongue complex, the tension is released, and these counter-forces act to move the upper housing away from the lower complex. Thus, in some embodiments, the invention additionally provides the advantage of aiding the release of the latch and thus, facilitates convenient "unsecuring" of any objects secured by the latch.

These and other objects, features, and advantages of the invention will be apparent through the detailed description of the drawings attached hereto. It is also to be understood that both the foregoing summary and the following detailed description are exemplary and not restrictive of the scope of the invention.

DETAILED DESCRIPTION OF THE INVENTION

The invention provides an automatic latch. The automatic latch of the invention enables a first object and a second object that are movable relative to one another to be secured together using a single motion. For example, a box lid that is movable relative to a box body can be secured to the box body via the latch of the invention using only a single motion. The single motion causes a catch portion of the latch attached to the box lid to engage a tongue portion of the latch that is attached to the box body, forming a catch/tongue complex. A first spring portion of the latch then provides tension to hold the catch/tongue complex in place so that the box lid and the box body are secured together and remain secured until the latch is intentionally released. In some embodiments, a second spring portion also provides tension tending to separate/release the catch/tongue complex when the latch is intentionally released.

Figure 1:
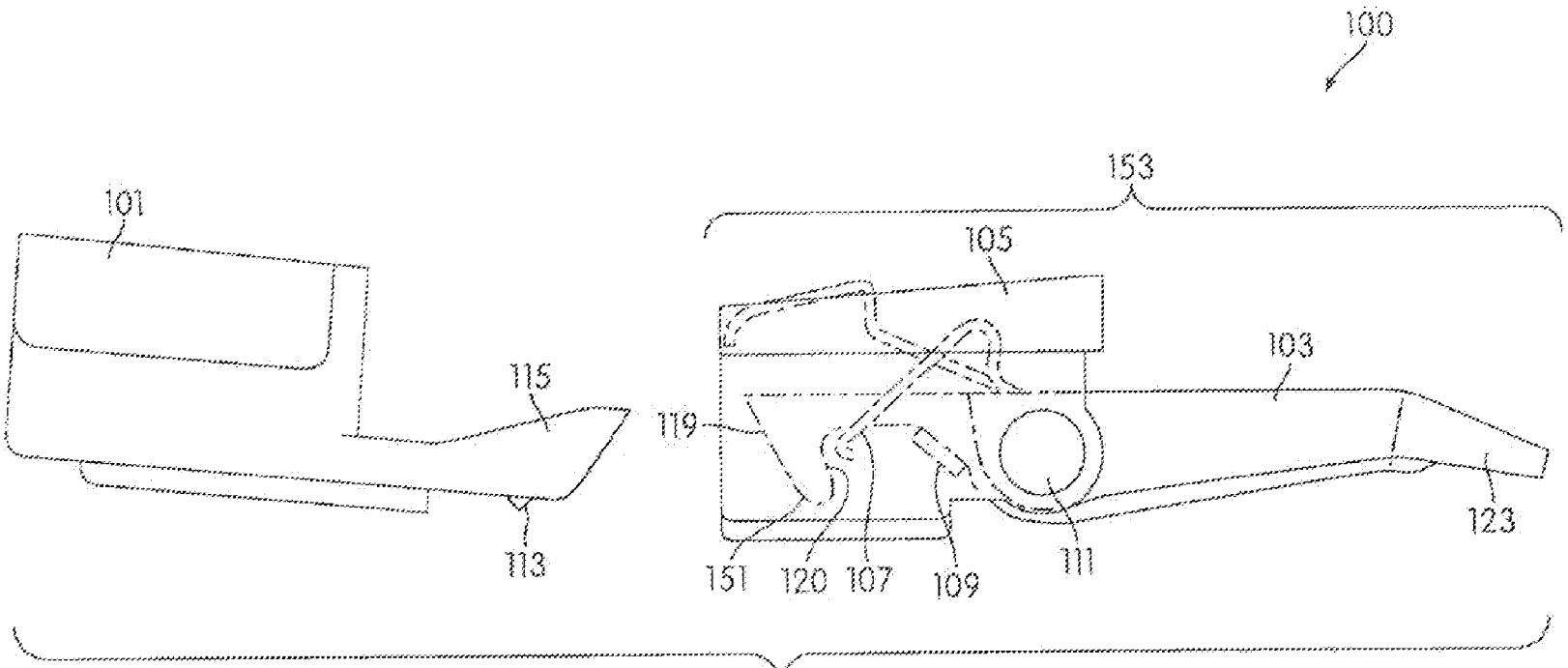
FIG. 1 illustrates an automatic latch according to an embodiment of the invention.

FIG. 1 illustrates an automatic latch 100 according to an embodiment of the invention. Automatic latch 100 comprises an upper housing 101, a tongue 103, a lower housing 105, a spring 107, and/or other elements. In some embodiments, upper housing 103 may be considered a first latch member or a first latch body. In some embodiments, lower housing 105 may be considered at least part of a second latch member or a second latch body. In some embodiments, tongue 103 may be considered a pivoted structure that may be pivotally connected with respect to lower housing 105 or other elements of automatic latch 100.

Figure 2:
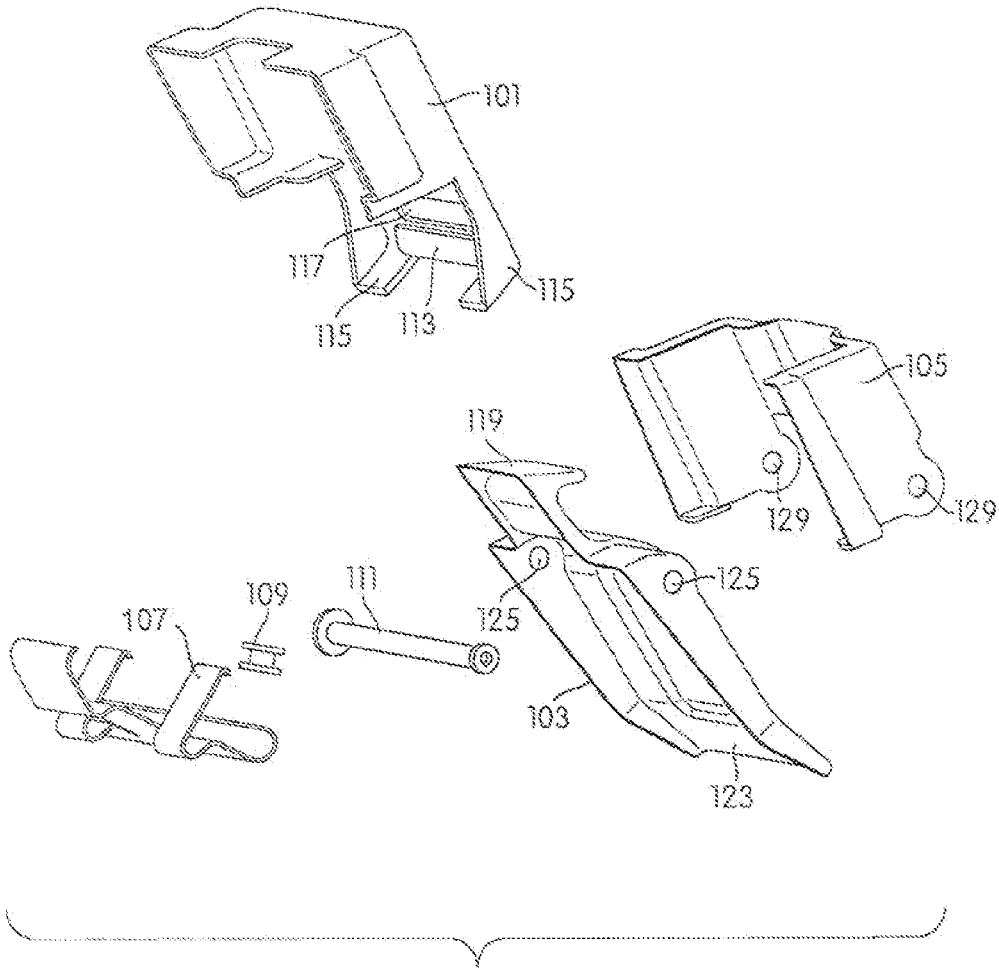
FIG. 2 illustrates an exploded view of an automatic latch according to an embodiment of the invention.

FIG. 2 illustrates an exploded view of automatic latch 100 according to one embodiment of the invention. Upper housing 101, includes a catch 113 that is flanked by two arms 115. Catch 113 forms the front edge of an opening 117, which is disposed through upper housing 101. In one embodiment, arms 115 protrude past catch 113. In some embodiments, catch 113 may be considered a cam structure. In some embodiments, catch 113, arms 115, and opening 117 engage tongue 103 and/or spring 107 when latch 100 is used to secure two objects.

Figure 3A:
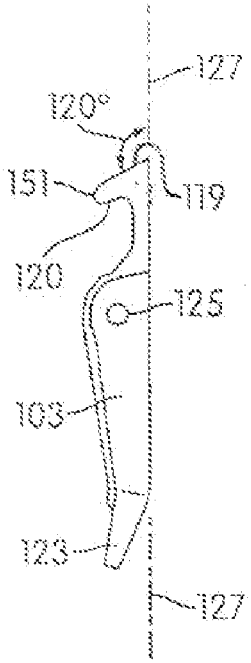
FIGS. 3A-3C illustrate multiple views of a tongue according to an embodiment of the invention.
Figure 3B:
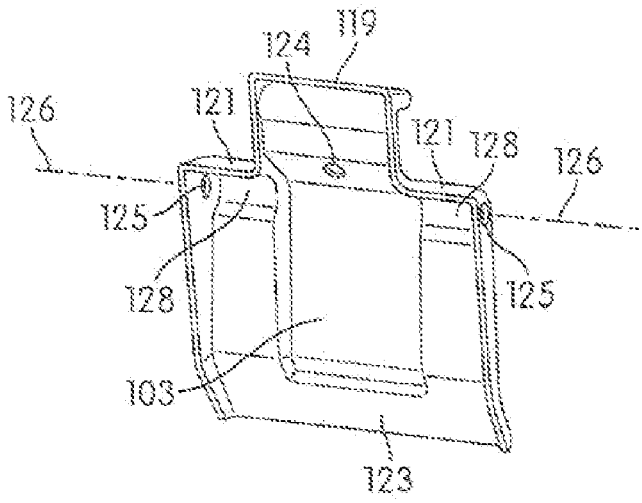
Figure 3C:
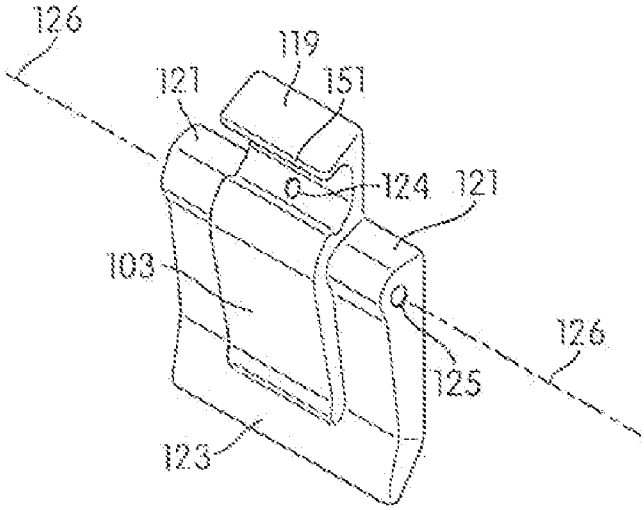

FIGS. 3A-3C illustrate tongue 101 according to one embodiment of the invention. Tongue 103 includes a leading edge 119 at its first end. As illustrated in FIGS. 3A, 3B, and 3C, leading edge 119 has an angled surface that forms a wedge extending along the entirety of leading edge 119. In some embodiments, leading edge 119 and its angled surface may be considered cam surface. At the "top" of the wedge is a top portion 151. The wedge formed by the angled surface of leading edge 119 terminates in a drop-off surface 120. In one embodiment, the angle of the surface of leading edge 119 may be approximately 120 degrees relative to the plane 127 of the body of tongue 103. Other angles may be utilized. In some embodiments, top portion 151, drop-off surface 120, and/or other elements of tongue 103 may be considered a protrusion formed on tongue 103.

In some embodiments, leading edge 119 protrudes from shoulders 121 which are set back father on the body of tongue 103. In some embodiments, tongue 103 also includes a tail 123 at its second end. In some embodiments, tongue 103 includes a hole 124 disposed through the body of tongue 103. In some embodiments, hole 124 is located behind leading edge 119 and drop-off surface 120 and relatively even with shoulders 121.

In some embodiments, tongue 103 also includes holes 125 disposed through the body of tongue 103. Holes 125 align with one another along axis 126. In some embodiments, axis 126 may be parallel with the main plane 127 of the body of tongue 103. Tongue 103 also includes bend receiving space 128 for receiving part of spring 107 as described below.

Figure 4A:
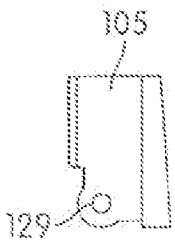
FIGS. 4A-4C illustrate multiple views of a lower housing according to an embodiment of the invention.
Figure 4B:
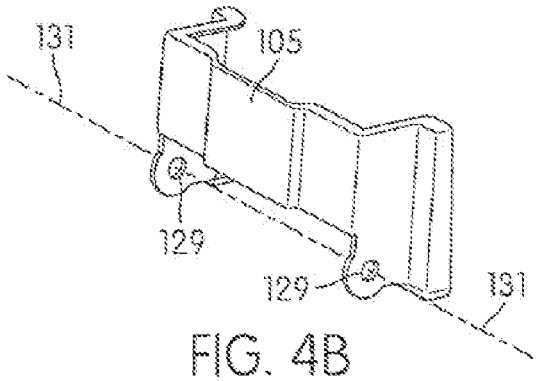
Figure 4C:
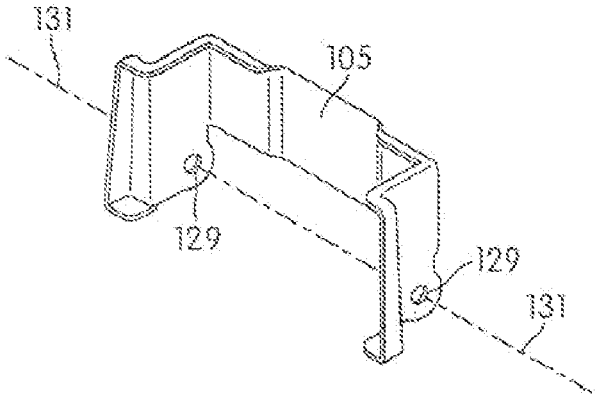
Figure 5B:
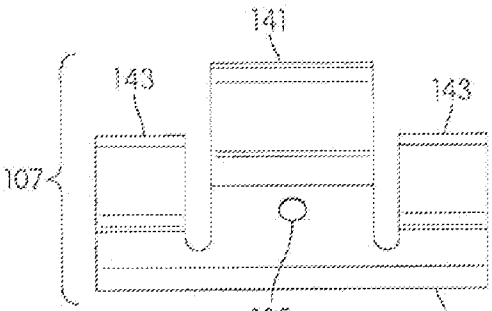
FIGS. 5A-5D illustrate multiple views of a spring according to an embodiment of the invention.
Figure 5D:
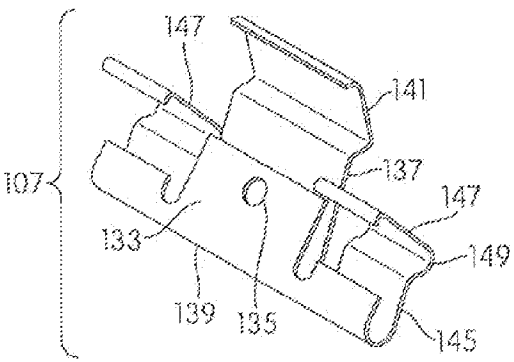
Figure 5A:
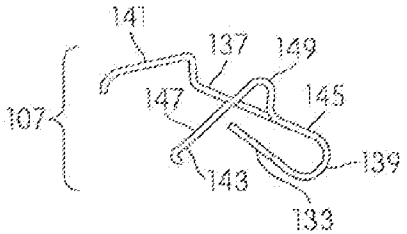
Figure 5C:
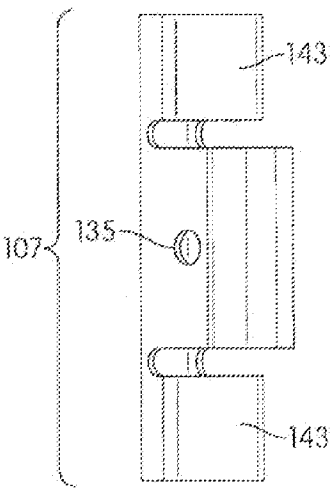

FIGS. 4A-4C illustrate lower housing 105 according to one embodiment of the invention. In one embodiment, holes 129 are disposed through the body of lower housing 105. Holes 129 align with one another along axis 131. In one embodiment, tongue 103 is fastened to lower housing 105 by placing lower housing 104 over tongue 103 such that holes 125 and holes 129 align, and inserting long fastener 111 through holes 125 and holes 129. When so fastened, tongue 103 may pivot within lower housing 105 around the axis running through long fastener 111.

FIGS. 5A-5D illustrate spring 107 according to an embodiment of the invention. In some embodiments, spring 107 includes a bottom surface 103. Bottom surface 133 includes a hole 135 disposed through the body of spring 107 that may be used to secure spring 107 to tongue 103 using short fastener 109, as discussed below. Spring 107 also includes an intermediate surface 137. Intermediate surface 137 opposes bottom surface 133 and is connected to bottom surface 133 via bend 139. Intermediate surface 137 is connected to top surface 141 which extends forward past bottom surface 133.

In some embodiments, spring 107 may also include two arms 143 that are connected to bend 139. Arms 143 flank bottom surface 133, intermediate surface 137, and top surface 141. Arms 143 may comprise outer intermediate surfaces 145 that are connected to bend 139 and on the same plane with intermediate surface 137 (at least when no forces are applied thereto). Arms 143 may also comprise forward surfaces 147 that are connected to outer intermediate surfaces 145 by bend 149. In some embodiments, forward surfaces 147 may extend forward at a steeper angle than top surface 141.

Spring 107 is rigid such that when forces are applied to any of the aforementioned surfaces (e.g., bottom surface 133, intermediate surface 137, top surface 141, outer intermediate surfaces 145, forward surfaces 147, or other elements of spring 107), it may contort according to those forces but will return to the conformation described herein and illustrated in the figures (or other predetermined conformation) when such forces are removed. As such, when forces are applied to one or more of the surfaces of spring 107, counter-forces, tension, and/or bias are created tending forward spring returning to the conformation described herein and illustrated in the figures or other predetermined conformation.

In one embodiment, spring 107 may include two spring portions or "stress areas." Each spring portion or stress area involving a set of surfaces and/or other elements of spring 107. For example, a first spring portion or first stress area may include bottom surface 133, intermediate surface 137, top surface 141, and bend 139 (these may be referred to as "first stress surfaces"). When a force or forces cause bottom surface 133 to move relative to intermediate surface 137 and/or top surface 141, the rigidity of spring 107 and bend 139 create counter-forces, tension (tension referring to potential energy generated by the counter-forces), and/or bias in the direction opposite to the relative movement.

Additionally, spring may include a second portion or second stress area including forward surfaces 147, outer intermediate surfaces 145, bottom surface 133, bend 139 and bend 149 (these may be referred to as "second stress surfaces"). When a force or forces cause forward surfaces 147 to move relative to (e.g., toward) outer intermediate surfaces 145 and/or bottom surface 133, the rigidity of spring 107, bend 149, and/or bend 139 create counter-forces, tension, and/or bias in the direction opposite to the relative movement.

Stress on certain areas of spring 107 may be produced by compression, separation, or other stress on areas of spring 107 (e.g., first spring portion or second spring portion).

In some embodiments, spring 107 may be integrally formed from a single piece of material. In some embodiments, spring 107 may be formed using multiple materials, multiple pieces of material, multiple springs and/or may comprise a plurality of component parts joined together or cooperating to perform the features and functions herein.

In some embodiments, spring 107 may be fastened to tongue 103 by aligning hole 135 of spring 107 with hole 124 of tongue 103 and placing short fastener 109 through hole 135 and 124. In some embodiments, the orientation of spring 107 to tongue 103 may be such that top surface 141 and forward surfaces 147 or spring 107 are oriented close to leading edge 119 and may be such that bend 139 rests in bend receiving space 128. FIG. 1 illustrates this orientation, while not specifically illustrating bend 139 inside bend receiving space 128. FIGS. 6B, 6E, 6H, and 6N also illustrate this orientation.

Figure 6C:
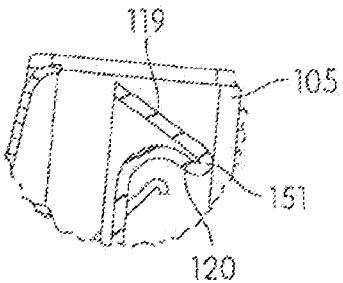
FIGS. 6A-6O illustrate multiple views of an automatic latch in various stages of engagement according to an embodiment of the invention (FIGS. 6B, 6C, 6E, 6F, 6H, 6I, 6K, 6L, 6N, and 6O being cross sectional views).
Figure 6B:
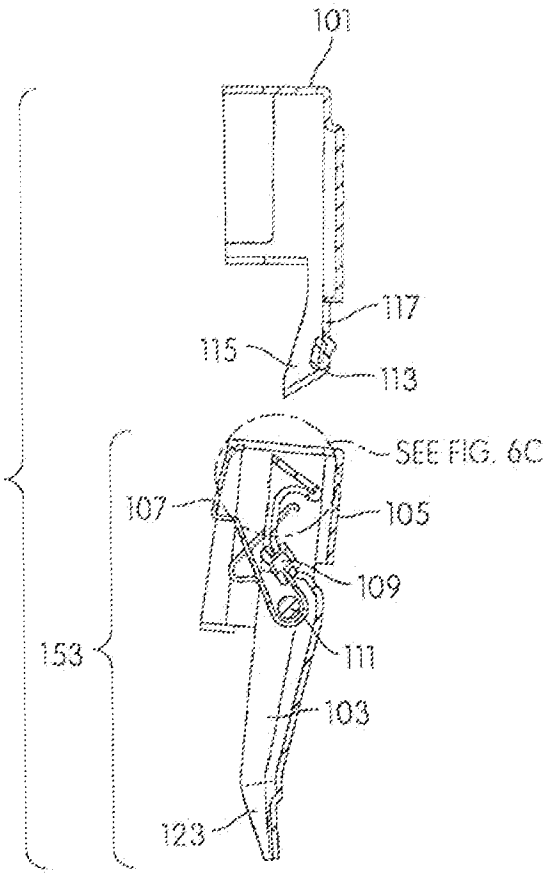
Figure 6A:
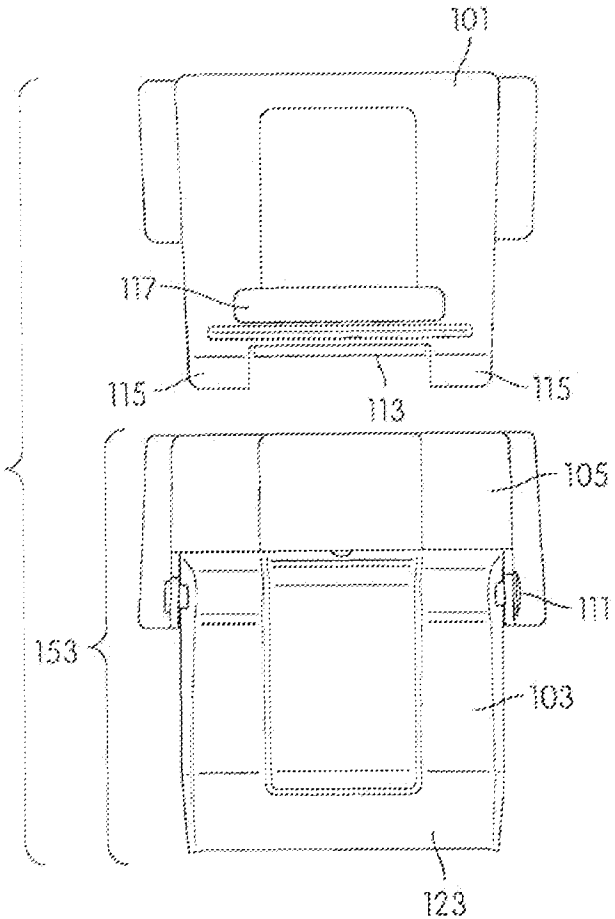
Figure 6F:
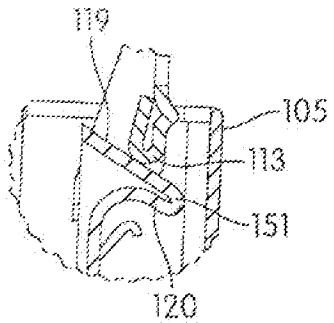
Figure 6E:
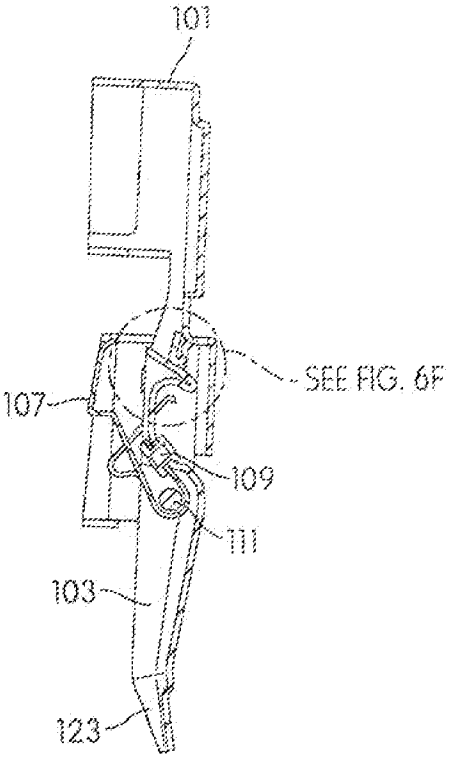
Figure 6D:
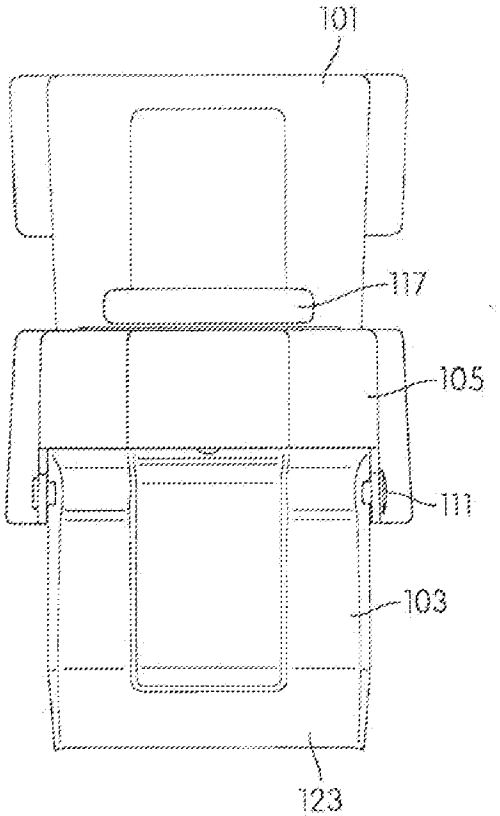
Figure 6I:
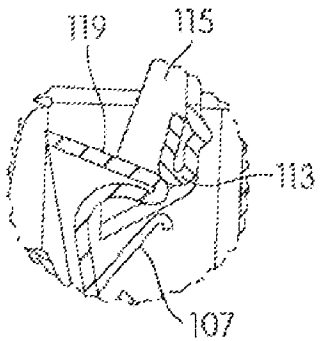
Figure 6H:
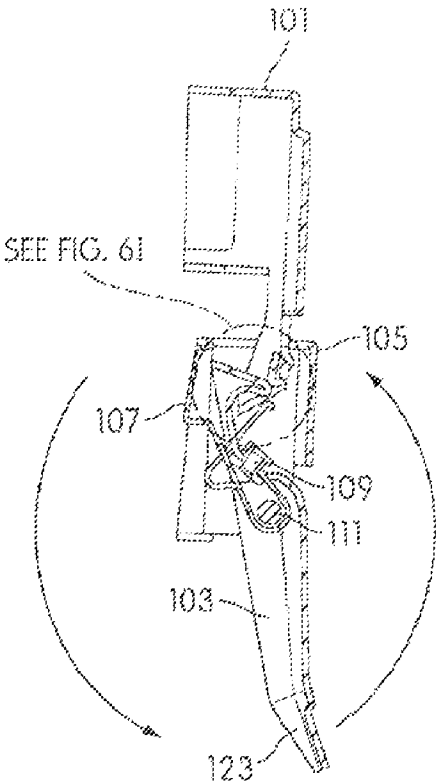
Figure 6G:
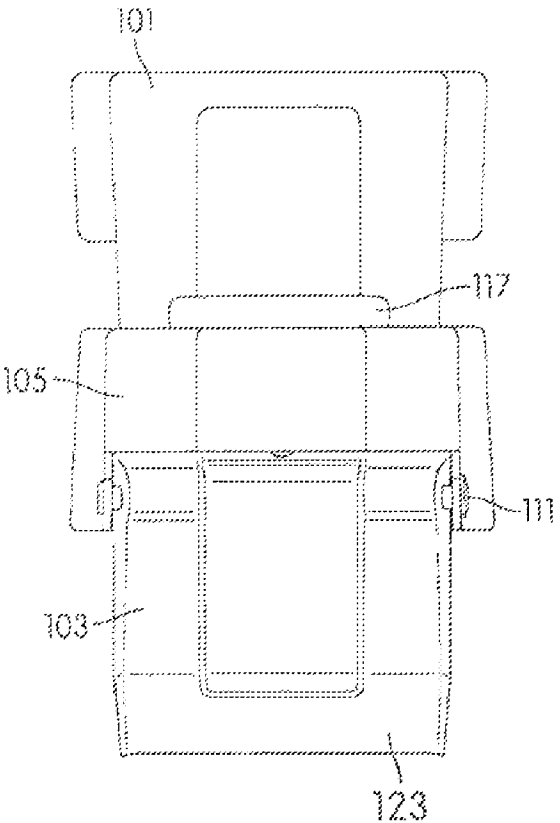
Figure 6L:
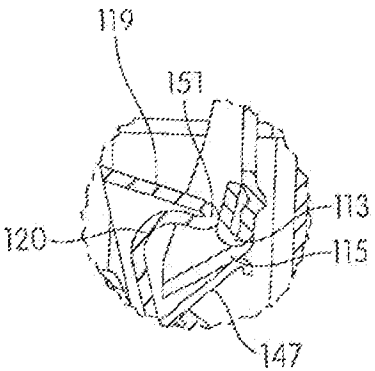
Figure 6K:
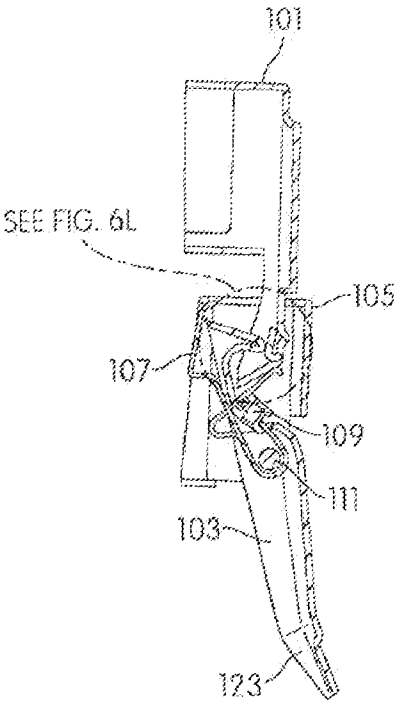
Figure 6J:
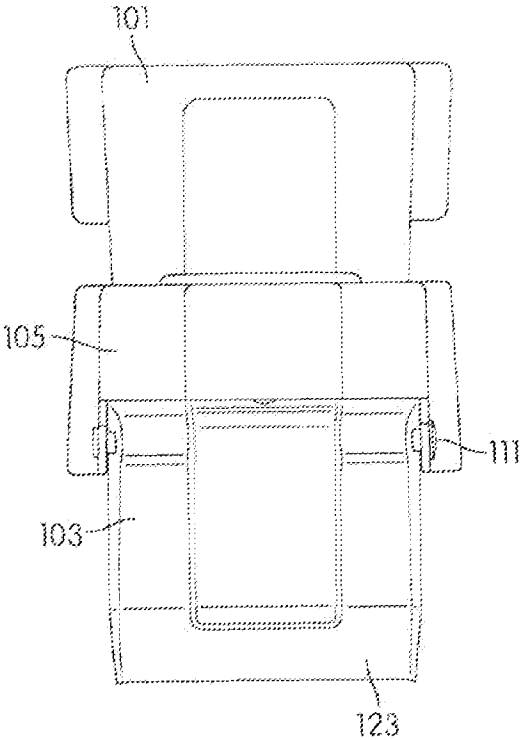
Figure 6O:
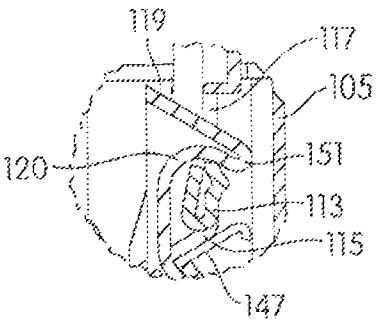

FIGS. 6A-6O illustrate an example of how catch/tongue of automatic latch 100 may be secured together according to an embodiment of the invention. FIGS. 6A and 6B illustrate an instance wherein upper housing 101 is separate from lower housing 105, tongue 103, spring 107 (lower housing 105, tongue 103, and spring 107 may be collectively referred to herein after as "lower complex 153"). In some embodiments, lower complex 153 may be referred to as a second latch member (upper housing 101 being referred to as a first latch member). As upper housing 101 (and thus, catch 113) is not engaged with lower complex 153, tongue 103, and spring 107 are in their unengaged positions, as illustrated in FIGS. 6B and 6C. FIG. 6C is a magnification of leading edge 119 of tongue 103 represented by the circled portion of FIG. 6B. Similarly, FIGS. 6F, 6I, 6L, and 6O are magnifications of the circled portions of FIGS. 6E, 6H, 6K, and 6N respectively.

In some embodiments, the unengaged position of tongue 103 includes top portion 151 of leading edge 113 engaging lower housing 105 as shown in FIGS. 6B and 6C. In some embodiments, this is because the mounting of tongue 103 onto spring 107 and lower housing 105 may, in conjunction with a first spring portion (or first stress area) create a tension, force, or bias tending to force top portion 151 of leading edge 113 to pivot clockwise around the axis of long fastener 111. For example, lower surface 133 of spring 107 may be stressed with the lower assembly is assembled and may create such force. In other embodiments, there may be no actual force or bias tending to pivot top portion 151 in this manner, and such forces may only be created when leading edge 113 is first pivoted in a counter-clockwise manner.

FIGS. 6D-6F illustrate an instance wherein upper housing 101 and lower complex 153 are moved relative to one another such that the cam structure (i.e., catch 113 of upper housing 101) begins to engage the cam surface (i.e., leading edge 119 of tongue 103). As illustrated in FIGS. 6E and 6F, catch 113 may have a rounded edge. When catch 113 engages the angled surface of leading edge 119, it creates a camming force tending to pivot leading edge 119 in a first direction around the axis of long fastener 111 (illustrated in the figures as counter-clockwise around the axis of long fastener 111). These forces stress lower surface 133 of spring 107 relative to intermediate surface 137 and upper surface 141 (i.e., the lower surface 133 is forced towards the intermediate surface 137, tensioning spring 107) which creates counter-force/bias tending to pivot leading edge 113 of tongue 103 in a second direction opposite to the first direction (e.g., clockwise around the axis of long fastener 111) and thus creates tension or bias tending in the second direction. In some embodiments, the first spring portion (i.e., the first stress area) creates the counter force or bias tending to pivot leading edge 113 in the second direction.

FIGS. 6G-6I illustrate an instance wherein upper housing 101 is advanced further towards lower complex 153 and catch 113 further engages leading edge 119. As can be seen in FIGS. 6H and 6I, the rounded edge of catch 113 engages the angled face of leading edge 119 and forces leading edge 119 to further pivot counter-clockwise (e.g., the first direction) around the axis of long fastener 111 (i.e., it is forced to the left as illustrated in FIGS. 6H and 6I). As a result of this pivot, tail 121 also pivots counter-clockwise around the axis of long fastener 111.

In some embodiments, an additional result of upper housing 101 being further advanced toward lower complex 153 is that arms 115 of upper housing 101 begin to engage forward surfaces 147 of arms 143 of spring 107. This begins to stress forward surfaces 147 relative to one or more of outer intermediate surfaces 145, lower surface 133 and/or other elements of spring 107 (e.g., the second spring portion or second stress area). This tress creates tension, forces, and/or bias opposing the advancement of arms 155 (i.e., bias tending to separate upper housing 101 from lower complex 153). In some embodiments, other elements of upper housing 101 may engage spring 107 to stress the second stress area or otherwise create forces, tension, and/or bias opposing advancement of upper housing 101 to lower complex 153.

FIGS. 6J-6L illustrate an instance wherein upper housing 101 is further advanced into lower complex 153 causing catch 113 to further engage leading edge 119 of tongue 103. As illustrated in FIGS. 6K and 6L, this further advancement causes catch 113 to travel up the angled edge of leading edge 119 and over top portion 151 of leading edge 119 (over the protrusion of tongue 103). In some embodiments, this further advancement also causes arms 115 of upper housing 101 to further engage arms 143 of spring 107, which causes further forces, tension, or bias against the advancement of arms 115 (and thus upper housing 101).

Figure 6N:
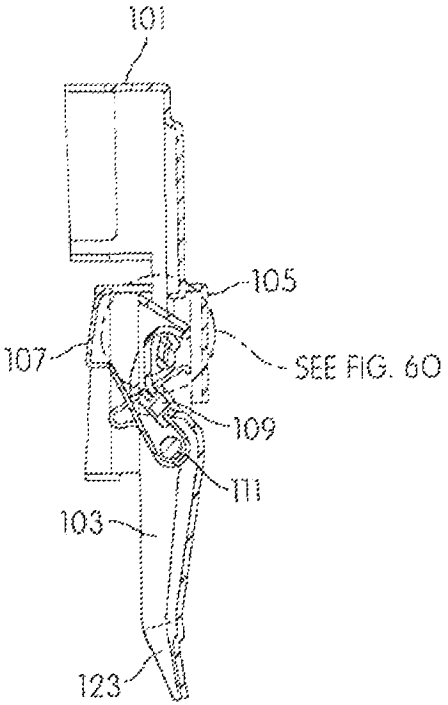
Figure 6M:
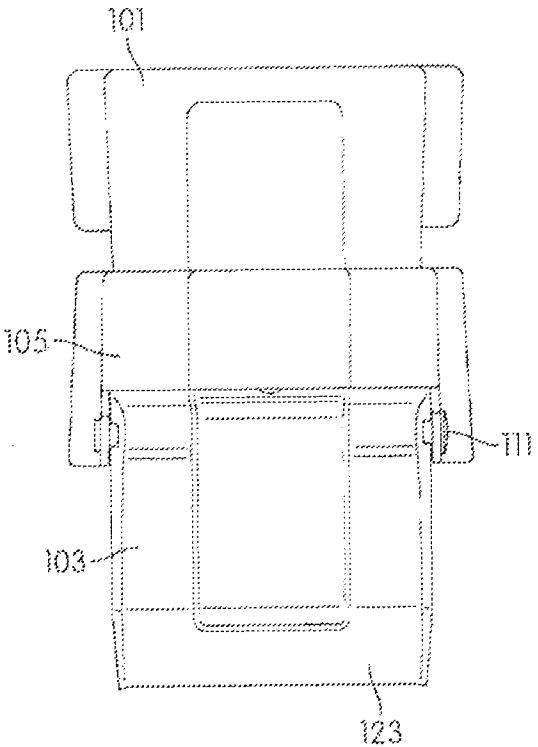

FIGS. 6M-6O illustrate an instance wherein upper housing 101 is fully inserted into lower complex 153 (e.g., a locked configuration or locking engagement). As illustrated by FIGS. 6N and 6O, once catch 113 clears top portion 151 of leading edge 119, the tension is at least partially released and forces/bias caused by spring 107 (e.g., the first spring portion or first stress area) that tend to pivot leading edge 119 clockwise around the axis of long fastener 111 (e.g., the second direction) cause top portion 151 of leading edge 119 to protrude through opening 117 of upper housing 101. In this position, drop-off surface 120 of leading edge has cleared and, in some embodiments, engages the inside edge of catch 113 (edge inside of opening 117). This position comprises the catch/tongue complex and secures upper housing 101 to lower complex 153 (e.g., a locked configuration or locking engagement). If forces are applied attempting to move upper housing 101 and lower complex 153 away from one another, the catch/tongue complex (e.g., drop-off surface 120 engaging the inside edge of catch 113) will inhibit such movement (unless unlatching steps are taken, such as those described below).

Figure 7:
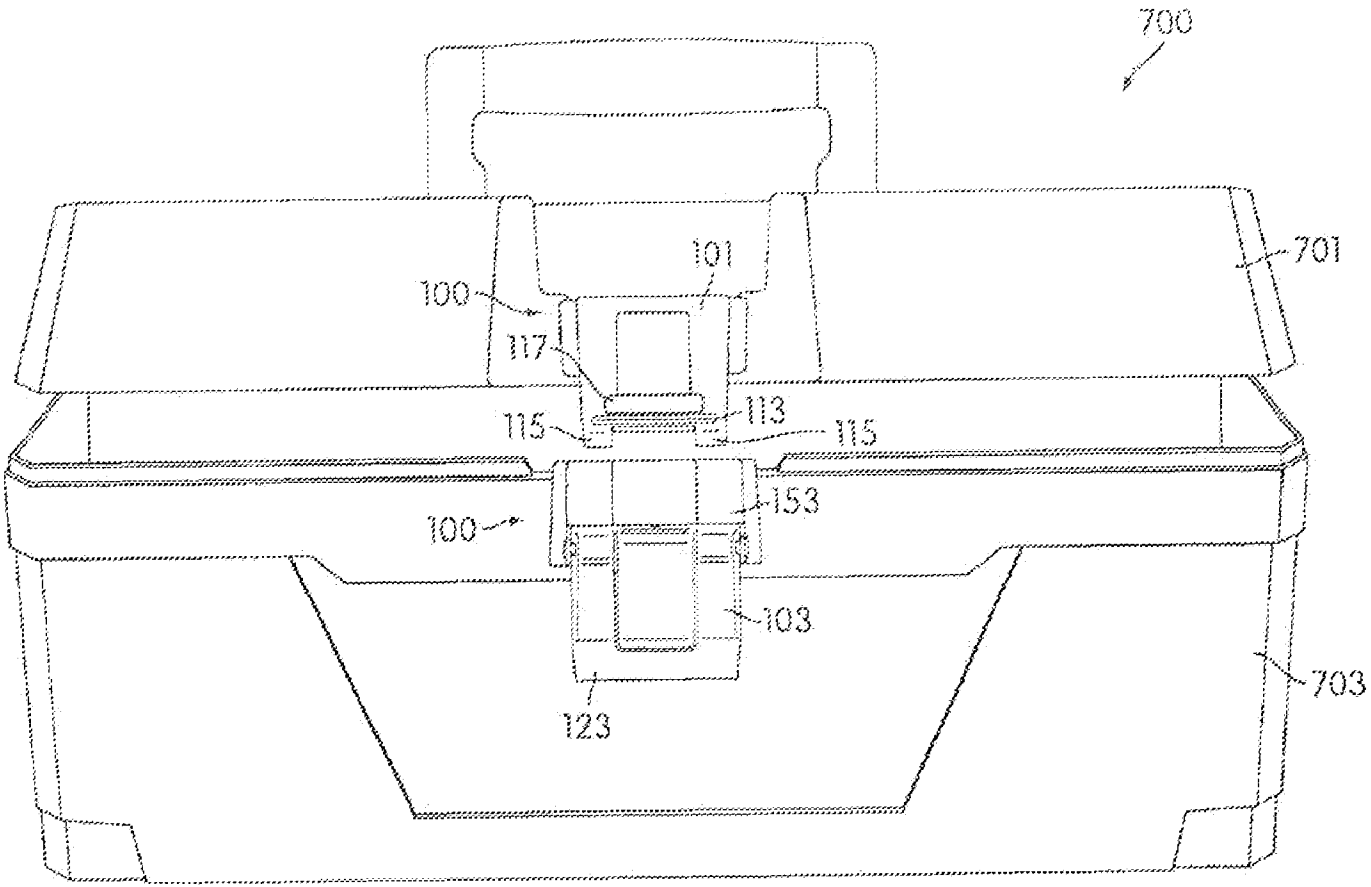
FIG. 7 illustrates an example of an automatic latch on a toolbox according to an embodiment of the invention.

Thus, automatic latch 100 may be used to secure together two objects that are movable relative to one another by attaching, for example, upper housing 101 to a first of the two objects and lower complex 153 (for example, lower housing 105) to a second of the two objects. For example, FIG. 7 illustrates an example of a tool box 700 equipped with an automatic latch 100 according to an embodiment of the invention. Toolbox 700 includes a container portion 703 and a lid portion 701. Lid portion 701 may be pivotally connected to container portion 703 and may be pivotally movable between closed an open positions.

As illustrated in FIG. 7, upper housing 101 (i.e., a first body or first latch member) may be attached to or be integrally part of lid portion 701 of toolbox 700 and lower complex 153 (i.e., second latch member) may be attached to or be integrally part of container portion 703 of toolbox 700 (e.g., lower housing 105 may be attached to or be integrally part of body 703 of toolbox 700). Lid 701 may be secured in one motion by simply closing lid 701 onto container portion 703, causing catch 113 of upper housing 101 to engage fully engage leading edge 119 (not illustrated in FIG. 7) of lower complex 153. In many instances, gravity will aid this process and minimal effort will be necessary to close and fully secure lid 701 of toolbox 700, thus further providing an advantage over previous latch mechanisms. In some embodiments, the positions of upper housing 101 and lower complex 153 relative to toolbox lid 701 and container portion 703 may be reversed such that upper housing 101 is secured to container portion 703 and lower complex 153 is secured to toolbox lid 701.

As mentioned above, latch 100 may be released (i.e., the catch/tongue complex may be disengaged and upper housing 101 may be disengaged from lower complex 153). In one embodiment, this may occur when a force is applied to tail 123 of tongue 103. With reference to FIGS. 6N and 6O, tail 123 may be pivoted in a counter-clockwise position around the axis of long fastener 111 (e.g., the first direction) causing leading edge 119 to likewise pivot counter-clockwise around the axis of long fastener 111. This removes to portion 151 of leading edge 119 from opening 117 of upper housing 101 (disengaging/clearing drop-off surface 120 from the inner edge of catch 113) and allows upper housing 101 to be withdrawn or otherwise moved away from lower complex 153.

As mentioned above, in some embodiments, engaging upper housing 101 with lower complex 153 (e.g., when closing toolbox 700) causes arms 115 (or other portion) of upper housing 101 to contact arms 143 of spring 107. This stresses spring 107 (e.g., in the second stress area or second spring portion) and causes the forces/bias that tend to move arms 115, and thus upper housing 101, away from the lower complex. However, these forces do not act to cause such movement while the catch/tongue complex is in the locked configuration (e.g., catch 113 is fully engaged with leading edge 119) as illustrated in FIGS. 6N and 6O. However, when tail 123 of tongue is pivoted counter-clockwise around the axis of long fastener 111 (e.g., the first direction), catch 113 and leading edge 119 are disengaged, the tension is released, and the forces/bias applied by the second spring portion or second stress area act to move upper housing 101 away from lower complex 153. Thus, in some embodiments, the invention additionally provides the advantages of aiding the release of the latch and thus, facilitates the "unsecuring" of the object secured by latch 100. For example, if latch 100 were used to secure lid portion 701 to container portion 703, a user may manipulate tail 123 to release upper housing 101 from lower complex 153. The forces caused by arms 115 of upper housing 101 to engage arms 143 of spring 107 (e.g., the second stress area) may cause the toolbox lid to "spring" open, adding additional convenience to the automatic latch of the invention over traditional latches. For example, it facilitates one-handed operation.

The orientation nomenclature used herein (e.g., upper, lower, top, forward, clockwise, counter-clockwise, etc.) may be considered relative in nature and for description purposes only. Thus, automatic latch may be used and/or operate in any orientation. In one embodiment, it is contemplated that FIGS. 1-7 are drawn to scale (i.e., not actual size, but in proportion).

In some embodiments, other housing configurations, spring configurations, catch configurations, tongue configurations, toolbox configurations, or other configurations may be used. For example, in some embodiments, the upper housing, first body, first latch member may be secured on a toolbox body and a lower complex, second latch member (including a second body) may be secured on a toolbox lid. In some embodiments, an opening may exist on a lower complex (along with a housing, pivot structure and/or a spring), while a protrusion that engages with the opening may exist on a first latch member (e.g., first body or upper housing). Other relative combinations may exist. Additionally an "opening" as referred to herein, need not comprise a through hole in an upper housing or other element of the latch, but may refer to an indentation, enclosed region, or any other type of element that can receive or interlock with a protrusion. Indeed, the opening, protrusion, catch, cam structure, cam surface, leading edge, top portion (e.g., top portion 151), drop-off surface, or other elements may comprise or be replaced by any combination of structures that interlock. In some embodiments, the features and functions of spring 107 disclosed herein may be performed by multiple springs and/or other elements.

While the invention has been described with reference to the certain illustrated embodiments, the word that have been used herein are words of description, rather than words of limitation. Changes may be made, within the purview of the associated claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the claims.

What is claimed is:

1. An automatic latch, comprising:

a first body including an opening therein, the first body including a cam structure;

a second body;

a pivoted structure pivotally connected with respect to the second body, the pivoted structure having a protrusion and a cam surface;

a first spring portion operatively connected with the pivoted structure such that the pivoted structure is biased in a first pivot direction by the first spring portion, the cam structure being movable into engagement with the cam surface to force the pivoted structure to pivot in a second pivot direction opposite the first pivot direction and against the bias of the first spring portion, until the protrusion can be moved into the opening, whereupon the first spring portion moves the pivoted structure in the first pivot direction so that the protrusion is moved into the opening and thereby forms a locked configuration between the first body and the second body; and a second spring portion that biases the first body away from the second body when the automatic latch is in the locked configuration such that when the protrusion is moved out of the opening, the second spring portion moves the first body away from the second body, wherein the first spring portion and the second spring portion are integrally formed as a single body.

2. The automatic latch of claim 1, wherein the first body includes at least one arm that engages the second spring portion when the automatic latch is in the locked configuration to cause the second spring portion to bias the first body away from the second body.

3. The automatic latch of claim 2, wherein the at least one arm includes two arms flanking the cam structure.

4. The automatic latch of claim 1, wherein the first body is mounted on a lid portion of a toolbox and the second body is mounted on a container portion of the toolbox.

5. The automatic latch of claim 1, wherein the first body is mounted on a container portion of a toolbox and the second body portion is mounted on a lid portion of the toolbox.

* * * * *